US010422346B2

(12) United States Patent
Hermes

(10) Patent No.: US 10,422,346 B2
(45) Date of Patent: Sep. 24, 2019

(54) BACKFEED STAGE, RADIAL TURBO FLUID ENERGY MACHINE

(71) Applicant: Siemens Aktiengesellschaft, Munich (DE)

(72) Inventor: Viktor Hermes, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 16/079,625

(22) PCT Filed: Mar. 1, 2017

(86) PCT No.: PCT/EP2017/054686
§ 371 (c)(1),
(2) Date: Aug. 24, 2018

(87) PCT Pub. No.: WO2017/148971
PCT Pub. Date: Sep. 8, 2017

(65) Prior Publication Data

US 2019/0055960 A1 Feb. 21, 2019

(30) Foreign Application Priority Data

Mar. 1, 2016 (DE) ..... 10 2016 203 305

(51) Int. Cl.
*F04D 29/44* (2006.01)
*F04D 17/12* (2006.01)
(Continued)

(52) U.S. Cl.
CPC ..... *F04D 29/444* (2013.01); *F04D 17/122* (2013.01); *F04D 29/053* (2013.01);
(Continued)

(58) Field of Classification Search
CPC ..... F04D 17/12; F04D 17/14; F04D 17/122; F04D 29/444; F04D 29/4213
(Continued)

(56) References Cited

U.S. PATENT DOCUMENTS 4,824,325 A * 4/1989 Bandukwalla ..... F04D 29/444 415/208.4

FOREIGN PATENT DOCUMENTS

DE 157924 C 10/1903
DE 723824 C 8/1942
(Continued)

OTHER PUBLICATIONS

English machine translation of JP 2015-94293, Feb. 15, 2019.*
(Continued)

*Primary Examiner* — Christopher Verdier
(74) *Attorney, Agent, or Firm* — Beusse Wolter Sanks & Maire

(57) ABSTRACT

A backfeed stage of a radial turbo fluid energy machine for deflecting a flow direction of a process fluid issuing from a rotor, rotating around an axis, from radially outward to radially inward, having a backfeed duct which has three adjacent sections in the flow direction, wherein a first section is designed for conducting the process fluid radially outward, wherein a second section is designed for deflecting the process fluid from the radially outward to radially inward direction, wherein a third section is designed for conducting the process fluid radially inward, wherein the second section and third section, or only the third section, have/has first guide vanes which define flow passages of the backfeed duct in relation to each other in the circumferential direction.

4 Claims, 3 Drawing Sheets

(51) Int. Cl.

| | |
|---|---|
| ***F04D 29/053*** | (2006.01) |
| ***F04D 29/42*** | (2006.01) |
| ***F04D 29/28*** | (2006.01) |
| ***F04D 29/66*** | (2006.01) |

(52) U.S. Cl.
CPC ..... *F04D 29/4213* (2013.01); *F04D 29/284* (2013.01); *F04D 29/666* (2013.01)

(58) Field of Classification Search
USPC ..... 415/199.1–199.3, 208.2–208.4, 211.2
See application file for complete search history.

(56) References Cited

FOREIGN PATENT DOCUMENTS

| | | | | | |
|---|---|---|---|---|---|
| JP | H0244516 | A | | 2/1990 | |
| JP | 11-173299 | A | * | 6/1999 | ..... F04D 29/444 |
| JP | 2015094293 | A | | 5/2015 | |

OTHER PUBLICATIONS

International Search Report with Written Opinion dated May 31, 2017, for PCT/EP2017/054686.
DE search report dated Feb. 14, 2017, for DE patent application No. 102016203305.0.

* cited by examiner

BACKFEED STAGE, RADIAL TURBO FLUID ENERGY MACHINE

CROSS REFERENCE TO RELATED APPLICATIONS

This application is the US National Stage of International Application No. PCT/EP2017/054686 filed Mar. 1, 2017, and claims the benefit thereof. The International Application claims the benefit of German Application No. DE 102016203305.0 filed Mar. 1, 2016. All of the applications are incorporated by reference herein in their entirety.

FIELD OF INVENTION

The invention relates to a backfeed stage of a radial turbo fluid energy machine, especially of a radial turbocompressor for deflecting a flow direction of a process fluid issuing from a rotor, rotating around an axis, from radially outward to radially inward, comprising a backfeed duct which has three adjacent sections in the flow direction, wherein a first section is designed for conducting the process fluid radially outward, wherein a second section is designed for deflecting the process fluid from radially outward to radially inward direction, wherein a third section is designed for conducting the process fluid radially inward, wherein the second section and third section, or only the third section, have/has first guide vanes which define flow passages of the backfeed duct in relation to each other in the circumferential direction.

BACKGROUND OF INVENTION

In a radial compressor (see FIG. 1), the fluid to be compressed exits an impeller, rotating around an axis, in the radial direction with a significant velocity component in the circumferential direction (swirl). The following static aerodynamically effective components in the flow direction have the task of converting the kinetic energy introduced in the impeller into pressure. In the case of a multistage single-shaft compressor, as known from JP000244516 for example, the fluid also has to be conducted toward the following impeller. Furthermore, the swirl is to be extracted from the flow so that flow onto the following impeller is swirl free as far as possible. This task is solved by means of a so-called backfeed stage, comprising a first section which conducts the process fluid radially outward, a second section which corresponds basically to a 180° bend, and a third section for conducting the process fluid radially inward for entry into the impeller following downstream. The third section also involves a deflection of the processing fluid from the radially inwardly directed flow into the axial direction toward the impeller inlet of the downstream impeller. The backfeed blading can in this case consist of individual blades arranged in a row in the circumferential direction, as is known from JP 11173299-A.

From JP2015094293(A) it is already known to arrange second downstream guide vanes closer to the pressure side of first upstream guide vanes.

The arrangement which is known from the prior art is not very compact—therefore comparatively space-consuming—and the throughflow is comparatively loss-impaired.

SUMMARY OF INVENTION

Starting from the problem and disadvantages of the prior art, the invention is set upon the task of developing a backfeed stage of the type defined in the introduction in such a way that a less space-consuming backfeed stage creates a less loss-impaired flow.

For achieving the object according to the invention, a backfeed stage of the type defined in the introduction with additional features is proposed. The invention also proposes a radial turbo fluid energy machine having such a backfeed stage.

In common technical parlance, it is also customary to refer to only the combination consisting of the second section with the third section as the backfeed stage and to define the first section as a diffuser located upstream thereof in the flow direction. The terminology of this document refers to the three series-arranged sections (S1, S2, S3; see figures) as the backfeed stage. In this case, consideration is to be given to the fact that the first section can be freely designed within the scope of the invention so that the first section, with or without blades, can for example be of flared, constant or tapering design in the meridional section in the flow direction.

In the context of the invention, geometric expressions, such as axial, tangential, radial or circumferential direction are always in relation to a rotation axis of an impeller of a radial turbo fluid energy machine, providing nothing to the contrary is specified in direct relationship.

The backfeed stage according to the invention has a distinct relationship with such an impeller since the backfeed stage circumferentially extends around the impeller downstream of the impeller exit in the case of a radial turbocompressor. As a rule, the backfeed stage is designed to be rotationally symmetrical to the axis at least with regard to the aerodynamically relevant aspects of the invention.

The backfeed stage according to the invention, as a consequence of the first guide vane and second guide vane which are arranged in series in the flow direction, is less space-consuming than a backfeed stage which does not have the two guide vane stages in series. An alignment of the flow with the inlet into the impeller following downstream is aerodynamically more efficient by means of the staged guide vane design.

The second guide vane stage according to the invention which is offset in the circumferential direction or the arrangement of the second guide vanes in the circumferential direction asymmetrically to the trailing edges of the first guide vanes leads to a reduction of the aerodynamic losses of the process fluid in the throughflow of the backfeed stage.

The realignment and deflection of the process fluid downstream of the exit from the impeller toward the inlet of the impeller following downstream is particularly low in losses and low in space consumption according to the invention. The bend length, which in the circumferential direction characterizes the distance between the two trailing edges of adjacent first guide vanes, is divided by the radial line through the leading edge of the second guide vanes which are arranged between the two first vanes in the circumferential direction into a pressure-side section and a suction-side section.

A particularly advantageous development of the invention provides that the second guide vanes are designed and arranged in such a way that the second guide vane which is arranged downstream between the two first guide vanes is arranged closer in the circumferential direction to the suction side of the adjacent first guide vane than to the pressure side of the other adjacent first guide vane.

It has been shown that the division of the bend length, which in the circumferential direction characterizes the distance between the two trailing edges of adjacent first guide vanes is particularly advantageous if the ratio of the suction-side section to the overall bend length lies between 0.2 and 0.4. This characteristic offset toward the suction side of a first guide vane, which defines the flow passage in the circumferential direction, leads to a turbulence-free and less separation-impaired throughflow, which is particularly low in losses.

BRIEF DESCRIPTION OF THE DRAWINGS

In the following text, the invention is described in more detail based on a specific exemplary embodiment with reference to drawings. In the drawings.

DETAILED DESCRIPTION OF INVENTION

Figure 1:
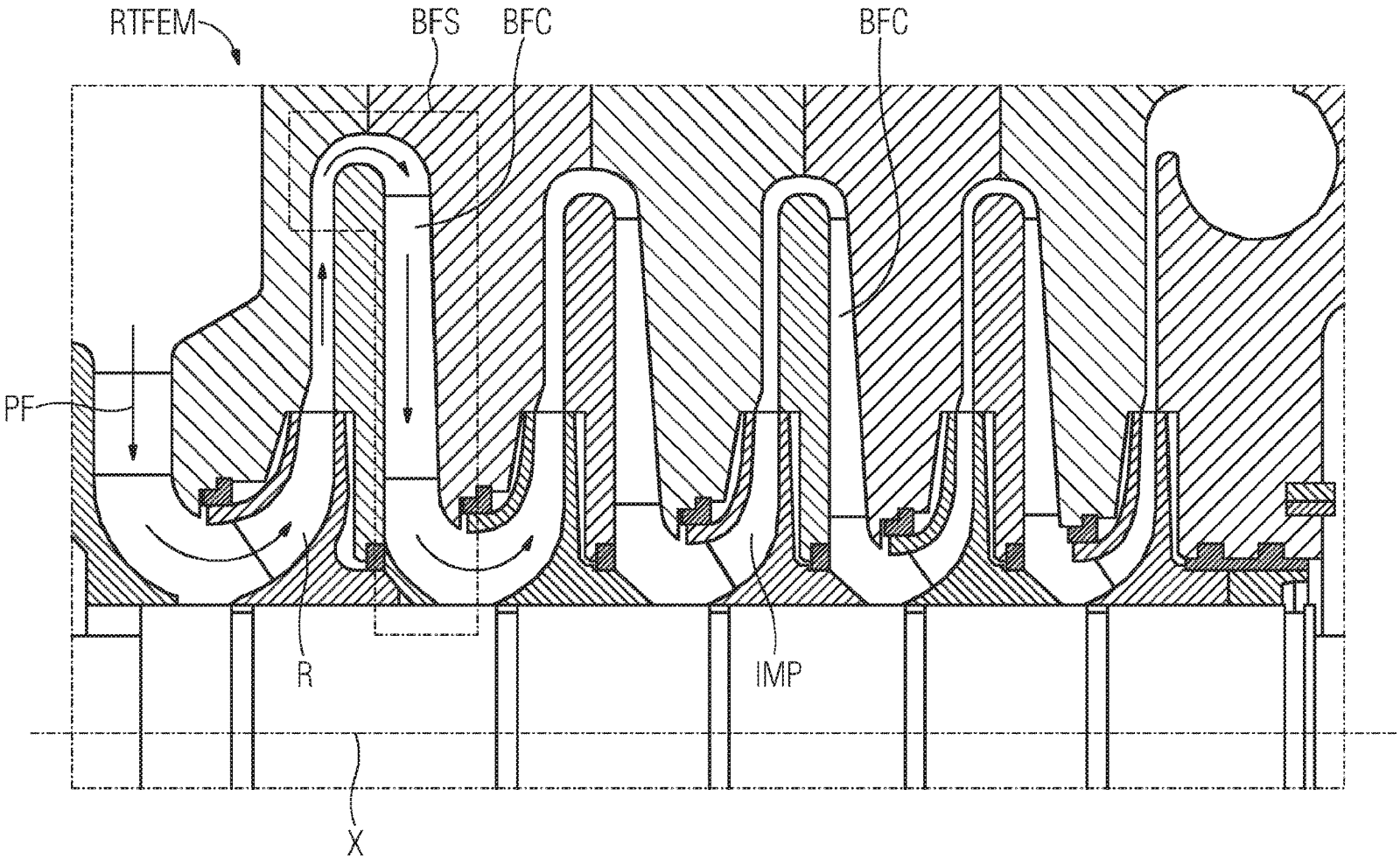
FIG. 1 shows a longitudinal section in a schematic view through the flow passage of a radial turbo fluid energy machine by way of example of a single-shaft compressor.

FIG. 1 shows a schematic representation of a longitudinal section of a radial turbo fluid energy machine RTFEM in the detail of a flow passage for a process fluid PF. The detail shows five impellers IMP which as a component part of a rotor R rotate around an axis X during operation. In reference to this axis X are all statements regarding this description, such as axial, radial, tangential or circumferential direction. The impellers IMP induct the process fluid PF axially in each case and transport this in an accelerated state radially outward. After exiting the impeller IMP, the process fluid PF makes its way into a backfeed stage BFS comprising a backfeed duct BFC.

Figure 2:
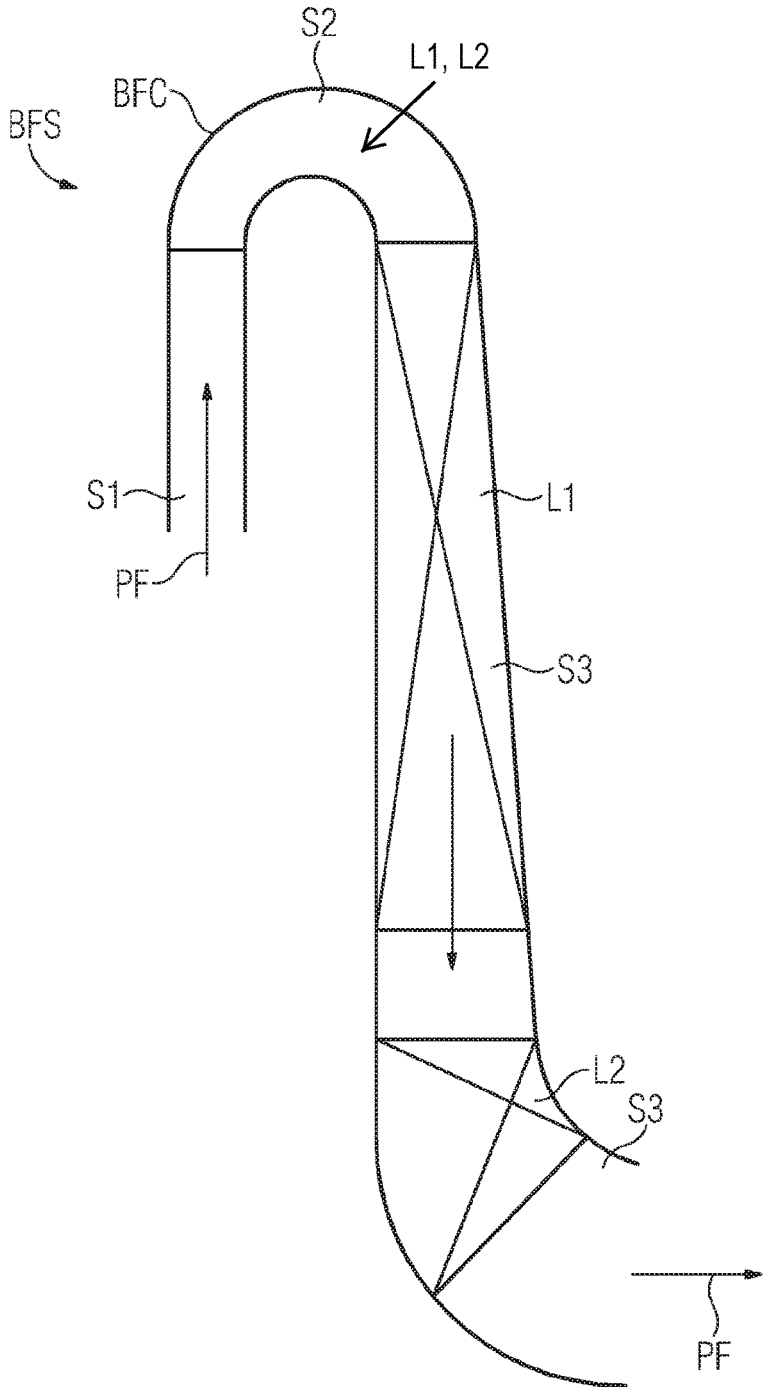
FIG. 2 shows a detail of FIG. 1, which is designated BFS in FIG. 1.

FIG. 2 shows the backfeed stage BFS or the backfeed duct BFC in detail. The process fluid PF makes its way out of the impeller IMP into a first section S1 of the backfeed duct, which is designed for conducting the process fluid PF radially outward. In the second section S2 located downstream, the process fluid PF is deflected from a flow direction radially outward to a flow direction radially inward. In the section S3 following this, the process fluid PF is guided radially inward and then fed axially to the following impeller IMP. The deflection of the process fluid PF in the second section S2 basically takes place in the form of a 180° bend. The deflection from a flow direction pointing radially inward in the third section S3 to the axial flow direction is carried out basically in a 90° bend.

Figure 3:
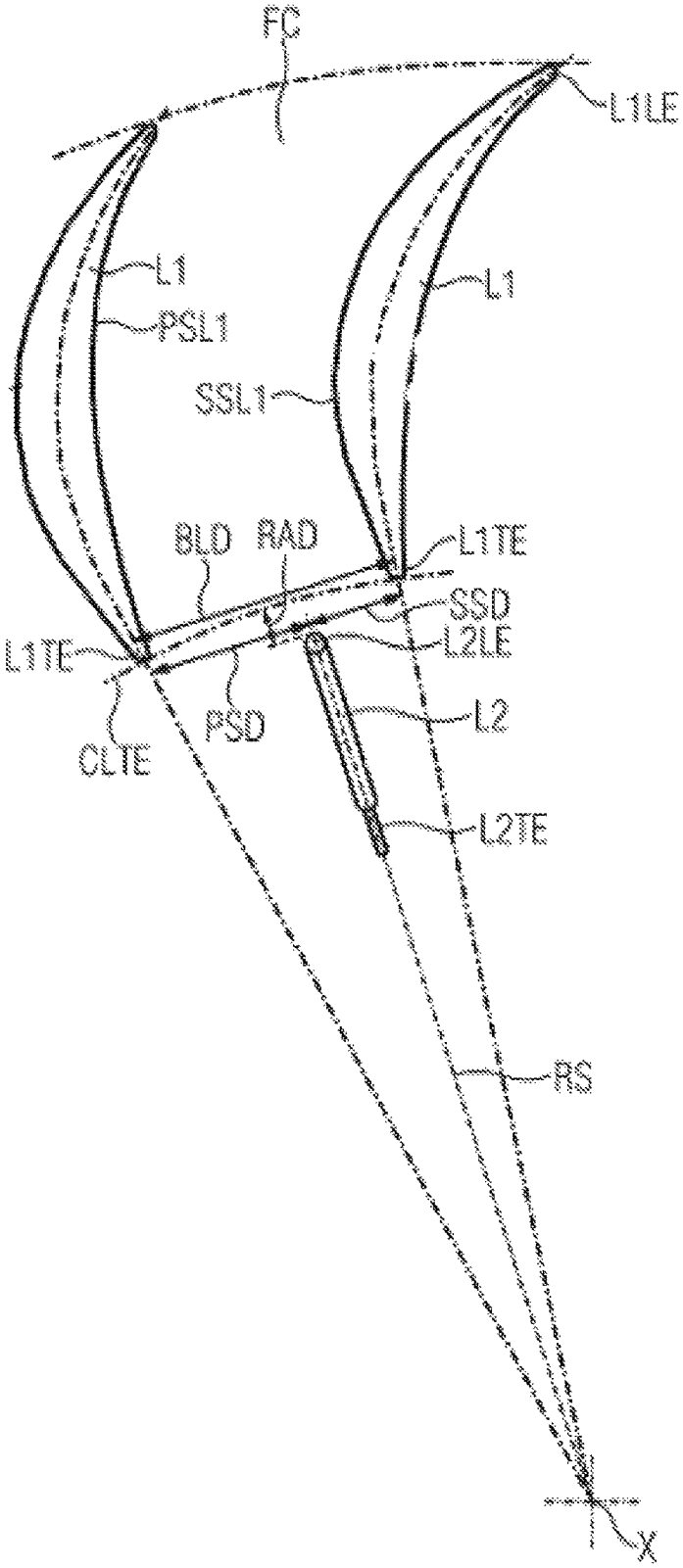
FIG. 3 shows a section through a third section of the backfeed stage in FIG. 2 in a radial plane at the axial position of the third section.

First guide vanes L1 and second guide vanes L2 are arranged in the section S2 and in the third section S3 or only in the third section S3 (The first guide vanes L1 and second guide vanes L2 are shown in FIG. 2 by reference only, whereas first guide vanes L1 and second guide vanes L2 are shown in detail in FIG. 3). The first guide vanes have a leading edge L1LE and a trailing edge L1TE. The second guide vanes L2 have a leading edge L2LE and a trailing edge L2TE. In this preferred exemplary embodiment, the leading edge L2LE of the second guide vanes L2 are located in a radial section RAD downstream and a smaller radius than the trailing edges L1TE of the first guide vanes L1—this arrangement being preferred according to the invention. Also to be considered within the scope of the invention are embodiments in which this radial section RAD is zero or the leading edges L2LE are located in the radial region of the first guide vanes L1. A flow passage FC in the circumferential direction between two first guide vanes L1 is defined in each case by a pressure side PSL1 of a first guide vane L1 and a suction side SSL1 of another first guide vane L1. In a radially extending plane (drawing plane of FIG. 3) in the region of the axial extent of the third section S3, a connecting line CLTE through two trailing edges L1TE of adjacent first guide vanes L1 can always be identified. This connecting line CLTE extends with a curvature radius which corresponds to the distance radius to the axis X. A bend length BLD of this connecting line CLTE between the two trailing edges L1TE of the adjacent first guide vanes L1 is not divided in the middle by a radial line RS through the leading edge L2LE of the second guide vane which is arranged between the two first guide vanes L1 in the circumferential direction. A first part of this connecting line CLTE is located between the leading edge L2LE of the second guide vanes L2 and the trailing edge L1TE of the first guide vane L1, which delimits the subject flow passage FC by its suction side SSD. This suction-side section SSD is smaller than the corresponding adjacent pressure-side section PSD. The ratio of the suction-side section SSD to the overall bend length BLD of the connecting line CLTE between the two trailing edges L1TE of the first guide vanes L1 is between 0.2 and 0.4. This type of unequal division of the flow passage FC between the two first guide vanes L1 by means of the following guide vane L2 leads to a particularly advantageous low-loss throughflow of the third section S3.

The invention claimed is:

1. A backfeed stage of a radial turbo fluid energy machine for deflecting a flow direction of a process fluid issuing from a rotor, rotating around an axis, from radially outward to radially inward, comprising:

a backfeed duct, which has three adjacent sections in the flow direction, wherein a first section is designed for conducting the process fluid radially outward, wherein a second section is designed for deflecting the process fluid from radially outward to radially inward, wherein a third section is designed for conducting the process fluid radially inward, wherein the second section and the third section, or only the third section, have/has first guide vanes which define flow passages of the backfeed duct in relation to each other in the circumferential direction, wherein the second section and the third section, or only the third section, have/has second guide vanes which are offset downstream by leading edges in relation to leading edges of the first guide vanes, which second guide vanes define flow passages of the backfeed duct in relation to each other in the circumferential direction, wherein the second guide vanes are designed and arranged in such a way that in a radially extending plane in the region of the axial extent of the third section a connecting line through two trailing edges of adjacent first guide vanes is not divided in the middle by a radial line through the leading edge of a second guide vane which is arranged between the two first guide vanes in the circumferential direction, wherein the first guide vanes each have a concave pressure side and a convex suction side and each flow passage in the region of the first guide vanes is defined by a pressure side of a first guide vane and a suction side of another adjacent first guide vane, wherein the second guide vane which is arranged downstream between the two first guide vanes is arranged closer to the suction side of the other adjacent first guide vane in the circumferential direction, and wherein a bend length (BLD) in the circumferential direction of the distance between the two trailing edges of adjacent first guide vanes is divided by the radial line through the leading edge of the second guide vane which is arranged between the two first guide vanes in the circumferential direction into a pressure-side section (PSD) and a suction-side section (SSD), wherein $0.2<SSD/BLD<0.4$ applies.

2. The backfeed stage as claimed in claim 1, wherein the first guide vanes and the second guide vanes are fixedly and immovably connected to a stator.

3. A radial turbocompressor comprising:

the backfeed stage as claimed in claim 1.

4. The backfeed stage as claimed in claim 1, wherein the radial turbo fluid energy machine comprises a radial turbocompressor.

* * * * *